US009112260B2

(12) United States Patent
Chakravarty et al.

(10) Patent No.: US 9,112,260 B2
(45) Date of Patent: Aug. 18, 2015

(54) MICROSTRIP ANTENNA

(71) Applicant: Tata Consultancy Services Limited, Mumbai (IN)

(72) Inventors: Tapas Chakravarty, Kolkata (IN); Purushothaman Balamuralidhar, Bangalore (IN)

(73) Assignee: Tata Consultancy Services Limited, Mumbai, Maharashtra (IN)

( * ) Notice: Subject to any disclaimer, the term of this patent is extended or adjusted under 35 U.S.C. 154(b) by 246 days.

(21) Appl. No.: 13/775,058

(22) Filed: Feb. 22, 2013

(65) Prior Publication Data

US 2013/0241794 A1 Sep. 19, 2013

(30) Foreign Application Priority Data

Feb. 24, 2012 (IN) ..... 511/MUM/2012

(51) Int. Cl.

| | |
|---|---|
| ***H01Q 1/38*** | (2006.01) |
| ***H01Q 9/04*** | (2006.01) |
| ***H01Q 21/29*** | (2006.01) |
| ***H01Q 25/00*** | (2006.01) |

(52) U.S. Cl.

CPC ..... *H01Q 9/0407* (2013.01); *H01Q 9/045* (2013.01); *H01Q 9/0457* (2013.01); *H01Q 21/293* (2013.01); *H01Q 25/00* (2013.01)

(58) Field of Classification Search

CPC ..... H01Q 9/0407; H01Q 9/0457
USPC ..... 343/700 MS, 846, 859
See application file for complete search history.

(56) References Cited

U.S. PATENT DOCUMENTS

| | | | | |
|---|---|---|---|---|
| 4,242,685 | A | 12/1980 | Sanford | |
| 5,406,292 | A * | 4/1995 | Schnetzer et al. | 343/700 MS |
| 5,565,875 | A * | 10/1996 | Buralli et al. | 343/700 MS |
| 6,317,084 | B1 * | 11/2001 | Chen et al. | 343/700 MS |
| 7,427,957 | B2 * | 9/2008 | Zeinolabedin Rafi et al. | 343/700 MS |
| 7,545,327 | B2 * | 6/2009 | Iellici et al. | 343/700 MS |
| 8,466,838 | B2 * | 6/2013 | Adada et al. | 343/700 MS |
| 2004/0051675 | A1 * | 3/2004 | Inoue | 343/728 |
| 2007/0096989 | A1 | 5/2007 | Chang et al. | |

(Continued)

FOREIGN PATENT DOCUMENTS

EP 1 804 335 A1 7/2007

OTHER PUBLICATIONS

Zhuochuan Huang, et al., "Multibeam Antenna-Based Topology Control with Directional Power Intensity for Ad Hoc Networks", IEEE Transactions on Mobile Computing, vol. 5, Issue No. 5, pp. 508-517 (May 2006).

(Continued)

*Primary Examiner* — Tho G Phan

(74) *Attorney, Agent, or Firm* — Blakely, Sokoloff, Taylor & Zafman LLP

(57) ABSTRACT

The subject matter described herein relates a microstrip antenna. In one implementation, the microstrip antenna comprises a dielectric substrate, a first metallic layer on a first side of the dielectric substrate and a second metallic layer on a second side, opposite to the first side, of the dielectric substrate. The first metallic layer on the dielectric substrate comprises one or more end-to-end slots to divide the first metallic layer into a plurality of microstrip patches. The microstrip antenna also comprises a feed circuit which is electromagnetically coupled to the plurality of microstrip patches and the second metallic layer.

17 Claims, 11 Drawing Sheets

(56) References Cited

U.S. PATENT DOCUMENTS

| | | | |
|---|---|---|---|
| 2009/0021439 | A1 | 1/2009 | Kanno et al. |
| 2009/0051598 | A1 | 2/2009 | McCarrick et al. |

OTHER PUBLICATIONS

Yu Jian Cheng, et al., "Millimeter-Wave Miniaturized Substrate Integrated Multibeam Antenna", IEEE Transactions on Antennas and Propagation, vol. 59, Issue No. 12, pp. 4840-4844 (Dec. 2011).

Chi-Yuk Chiu, et al., "Reduction of Mutual Coupling Between Closely-Packed Antenna Elements", IEEE Transactions on Antennas and Propagation, vol. 55, Issue No. 6, pp. 1732-1736 (Jun. 2007).

Benoît Poussot, et al., "Diversity Measurements of a Reconfigurable Antenna with Switched Polarizations and Patterns", IEEE Transactions on Antennas and Propagation, vol. 56, Issue No. 1, pp. 31-38, (Jan. 2008).

European Search Report for corresponding European Patent Application No. 13156364, 2 pages, (Jun. 13, 2013).

* cited by examiner

MICROSTRIP ANTENNA

TECHNICAL FIELD

The present subject matter relates to radio antennas and, particularly but not exclusively, to microstrip antennas.

BACKGROUND

Antennas are devices that are configured to transmit and/or receive electromagnetic (EM) radiations of predefined frequencies. The transmitted or the received EM radiations carry data for the purpose of wireless communication of data from one place to another. The antennas are coupled with a suitable transceiver which feeds electrical signals, coded with the data, which are converted by the antenna to EM radiations for transmission, and conversely, converts EM radiations that are received by the antenna, into electrical signals.

Microstrip antennas, also known as patch antennas, are a certain type of antennas that are known for transmission and reception of EM radiations in a radio frequency (RF) range. A typical microstrip antenna includes a dielectric substrate in the form of a slab, having a metallic microstrip patch on one surface and a metallic ground layer on the other. While operating in a transmission mode, the microstrip antenna is fed with electrical signals, through an RF transceiver, based on which the metallic microstrip patch radiates EM radiations of a predetermined RF. In a receiving mode, the metallic microstrip patch of the microstrip antenna receives the EM radiations of the predefined RF, based on which electrical signals are produced in the microstrip antenna and are supplied to the RF transceiver.

Microstrip antennas are popular for their use in wireless communication devices, such as mobile phones, personal digital assistants, portable computers as they possess numerous advantages, like compact size, light weight, planar structure, conformal, compatible for embedded antennas, integrable with integrated circuits and low manufacturing cost.

SUMMARY

This summary is provided to introduce concepts related to a microstrip antenna. This summary is neither intended to identify essential features of the claimed subject matter nor is it intended for use in determining or limiting the scope of the claimed subject matter.

In accordance with an embodiment of the present subject matter, a microstrip antenna is described. The microstrip antenna comprises a dielectric substrate, a first metallic layer on a first side of the dielectric substrate and a second metallic layer on a second side, opposite to the first side, of the dielectric substrate. The first metallic layer on the dielectric substrate comprises one or more end-to-end slots to divide the first metallic layer into a plurality of microstrip patches. The microstrip antenna also comprises a feed circuit which is electromagnetically coupled to the plurality of microstrip patches and the second metallic layer.

BRIEF DESCRIPTION OF DRAWINGS

The detailed description is described with reference to the accompanying figures. In the figures, the left-most digit(s) of a reference number identities the figure in which the reference number first appears. The same numbers are used throughout the figures to reference like features and components. Some embodiments of system and/or methods in accordance with embodiments of the present subject matter are now described, by way of example only, and with reference to the accompanying figures, in which:

FIG. 2(*b*) illustrates a top view of a multi-beam microstrip antenna of FIG. 2(*a*), according to an embodiment of the present subject matter.

FIG. 2(*c*) illustrates a bottom view of a multi-beam microstrip antenna of FIG. 2(*a*), according to an embodiment of the present subject matter.

FIG. 3(*b*) illustrates a top view of a multi-beam microstrip antenna of FIG. 3(*a*), according to an embodiment of the present subject matter.

FIG. 3(*c*) illustrates a bottom view of a multi-beam microstrip antenna of FIG. 3(*a*), according to an embodiment of the present subject matter.

FIG. 4(*b*) shows a simulated radiation pattern for a microstrip antenna, according to another embodiment of the present subject matter.

FIG. 4(*c*) shows a simulated radiation pattern for a microstrip antenna, according to another embodiment of the present subject matter.

FIG. 4(*d*) shows a simulated radiation pattern for a microstrip antenna, according to another embodiment of the present subject matter.

It should be appreciated by those skilled in the art that any block diagrams herein represent conceptual views of illustrative systems embodying the principles of the present subject matter. Similarly, it will be appreciated that any flow charts, flow diagrams, state transition diagrams, pseudo code, and the like represent various processes which may be substantially represented in computer readable medium and so executed by a computer or processor, whether or not such computer or processor is explicitly shown.

DETAILED DESCRIPTION

The present subject matter relates to microstrip antennas. The microstrip antennas of the present subject matter can be configured as single-beam or multi-beam microstrip antennas in which directions of transmitting and receiving electromagnetic (EM) radiations and number of main lobes in the radiation pattern can be configured in a substantially easy and efficient manner.

Figure 1:
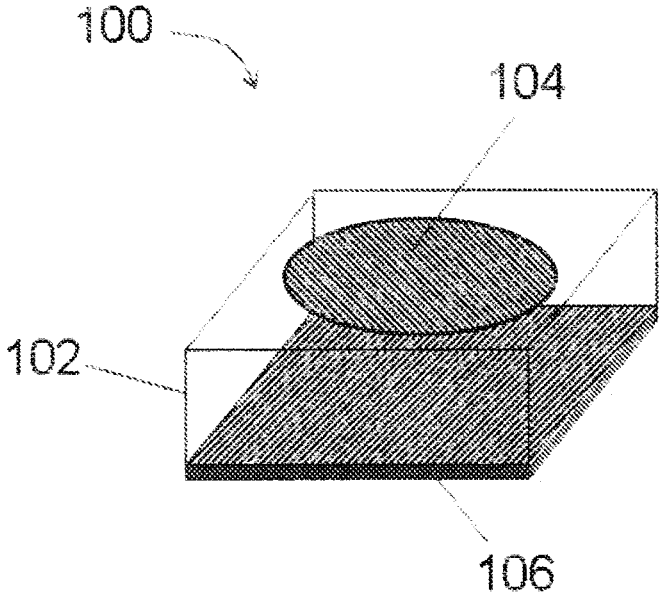
Figure 1 Prior Art
FIG. 1 illustrates a conventional microstrip antenna.

FIG. 1 schematically illustrates a conventional single microstrip antenna 100. The microstrip antenna 100 has a dielectric substrate 102 with, a metallic microstrip patch 104 on one surface of the dielectric substrate 102 and a metallic ground layer 106 on the other surface of the dielectric substrate 102, as shown. The metallic microstrip patch 104 and the metallic ground layer 106 are typically made of copper or gold and are of thickness of a few microns, whereas the dielectric substrate 102 is selected to have a predefined dielectric constant and a predefined height, as these parameters influence the antenna characteristics, such as operating frequency, efficiency, bandwidth, and power gain, of the microstrip antenna 100. The microstrip antenna 100 is fed with electrical signals through a feed line and a radio frequency (RF) transceiver (both not shown in FIG. 1), based on which the metallic microstrip patch 104 radiates EM radiations of a predefined RF.

The metallic microstrip patch 104 on the dielectric substrate 102 is a single continuous patch, typically, of a circular, square or rectangular shape, and the metallic ground layer 106 is a single continuous layer, typically, of a square or rectangular shape. Dimensions of the metallic microstrip patch 104 along the horizontal plane are determined based on the operating frequency of the microstrip antenna 100. The dimensions are typically about ¼ times or about ½ times a free-space wavelength of the EM radiations at the operating frequency. Thus, in an example, for the microstrip antenna 100 to operate at an RF of a few gigahertz (GHz), say 3 GHz, the metallic microstrip patch 104 may be of a circular shape of a radius of a few tens of millimeters (mm), say 25 mm, along the horizontal plane, Although, the conventional microstrip antenna 100 has a compact size, light weight, is planar, has a conformal structure and compatibility for embedded antennas, and can be conveniently integrated within integrated circuits and has low manufacturing cost. Also, it has low operational efficiency, low power gain, and low bandwidth.

Further, the conventional microstrip antenna 100, as shown in FIG. 1, has a radiation pattern with a single main radiation lobe, say having a substantially hemi-spherical shape above the antenna plane, and having a wide beam width. The radiation pattern of an antenna can be understood as a 3-dimensional plot representing directions in which or from which the antenna transmits or receives the EM radiations, and also represents the power gains of the transmitted or received EM radiations. Regions in which the antenna transmits or receives the EM radiations with substantially high power gains are usually represented by main radiation lobes in the radiation pattern. Thus, it is understood that the conventional microstrip antenna 100, with the single main radiation lobe and substantially wide beam width in the radiation pattern, transmits and receives EM radiations uniformly in a substantially wider region. With such a radiation pattern, the conventional microstrip antenna 100, typically in indoor environments, suffers from loading problems due to reflections or blockages of EM radiations from obstructions, like metals and walls, in the vicinity. The loading of the microstrip antenna 100 causes a phenomenon referred to as shadowing, along the propagation path of the EM radiations. This leads to distortions in the radiation pattern of the microstrip antenna 100 and may hinder the transmission and reception of EM radiations.

Conventionally, the loading problems, as described above, may be over come by designing a single-beam microstrip antenna or a multi-beam microstrip antenna. A single-beam microstrip antenna, typically, has a substantially higher power gain in one direction, which leads to a radiation pattern with a single distinct main radiation lobe in that direction, with deep nulls around the main radiation lobe. A deep null in a radiation pattern can be understood as a region in which the power gains of the transmitted or the received EM radiations is substantially low. A multi-beam microstrip antenna, typically, has substantially higher power gains in more than one direction, which leads to a radiation pattern with multiple distinct main radiation lobes in distinct directions, with deep nulls in between the main radiation lobes.

Conventionally, an antenna providing high power gain in one or more directions, which may also be referred to as directional gain of the antenna, is achieved by configuring an array of individual microstrip antennas in the direction(s) in which high power gain of the antenna is to be achieved. Such a configuration leads to a substantial increase in the overall size of the conventional microstrip antenna. Furthermore, a conventional multi-beam microstrip antenna with arrays of individual microstrip antennas is configured with one or more phase shifters that are provided with the antenna to avoid phase/amplitude mismatch between the individual microstrip antennas, This makes the configuration of the conventional multi-beam microstrip antenna complex and also increases the cost of the microstrip antenna.

The present subject matter describes microstrip antennas that can be used for wireless communication of data. The microstrip antenna of the present subject matter may be configured as a single-beam or a multi-beam microstrip antenna, having substantially the same dimensions as those of a conventional single microstrip antenna. The radiation pattern of the microstrip antenna of the present subject matter may include one or more main radiation lobes with narrow beam widths and high power gains in one or more predefined directions, where the main radiation lobes have substantially deep nulls around them, In an implementation, the microstrip antenna includes a dielectric substrate with a first metallic layer on a first side and a second metallic layer on the side opposite to the first side. The second metallic layer can function as a ground layer of the microstrip antenna, and the first metallic layer can function as a metallic microstrip patch of the microstrip antenna that transmits and receives the EM radiations, According to an aspect of the present subject matter, the first metallic layer has one or more end-to-end slots that divide the first metallic layer into a plurality of microstrip patches. An end-to-end slot may be understood a region, from one peripheral end to another peripheral end of the first metallic layer, without any material of the first metallic layer. The one or more end-to-end slots in the first metallic layer may be of a predefined width and a predefined shape selected based on a radiation pattern of the microstrip antenna.

The microstrip antenna of the present subject matter also includes a feed circuit. The feed circuit may be electromagnetically coupled to the second metallic layer and the plurality of microstrip patches of the first metallic laver. In an implementation, the feed circuit may be embedded in the dielectric substrate and configured between the first metallic layer and the second metallic laver. Further, the feed circuit may be coupled to an RF transceiver which sends and receives RF electrical signals to and from the feed circuit during the operation of the microstrip antenna.

In an implementation, the second metallic layer may have no slots, one end-to-centre slot, one end-to-end slot, one end-to-end and one end-to-centre slot, or two end-to-end slots. The one or more slots in the second metallic layer may be of a predefined width and a predefined shape selected based on a radiation pattern of the microstrip antenna.

The first metallic layer and the second metallic layer of the microstrip antenna of the present subject matter are of predefined dimensions along the horizontal plane of the dielectric substrate. The predefined dimensions may be selected based on the antenna characteristics, such as an operating frequency and a radiation pattern of the microstrip antenna. In an implementation, the predefined dimension of the first metallic layer may be in a range from about ¼ times to about ½ times a free-space wavelength at the operating frequency of the microstrip antenna. This indicates that the size of the microstrip antenna of the present subject matter is substantially similar to that of a conventional microstrip antenna.

Further, by making one or more slots in the first metallic layer and in the second metallic layer the antenna characteristics, such as radiation pattern, of the microstrip antenna of the present subject matter can be varied to include one or more main radiation lobes with substantially high power gains along predefined directions. Such a radiation pattern is obtained due to the distribution of power gain in accordance with the configuration of slots in the first metallic layer and in the second metallic layer. Further, the main radiation lobes in the radiation pattern of the microstrip antenna of the present subject matter have beam widths narrower than that of the conventional microstrip antenna, with deep nulls around the lobes. Furthermore, the operational bandwidth of the microstrip antenna of the present subject matter is larger than that of the conventional microstrip antenna, such that the microstrip antenna can transmit and receive the EM radiations over a wider frequency spectrum.

The antenna characteristics of the microstrip antenna, as described above, are achieved due to the one or more slots in the first metallic layer and in the second metallic layer, and due to a substantially strong mutual coupling amongst the plurality of microstrip patches of the first metallic layer, and coupling of the plurality of microstrip patches with the second metallic layer and the feed circuit. Thus, the microstrip antenna of the present subject matter is a compact microstrip antenna and can be configured as a single-beam or a multi-beam microstrip antenna, in which various characteristics of the antenna, such as directions of transmitting and receiving EM radiations and number of main lobes in the radiation pattern, can be configured in a substantially easy and efficient manner.

These and other advantages of the present subject matter would be described in greater detail in conjunction with the following figures. It should be noted that the description and figures merely illustrate the principles of the present subject matter.

Figure 2A:
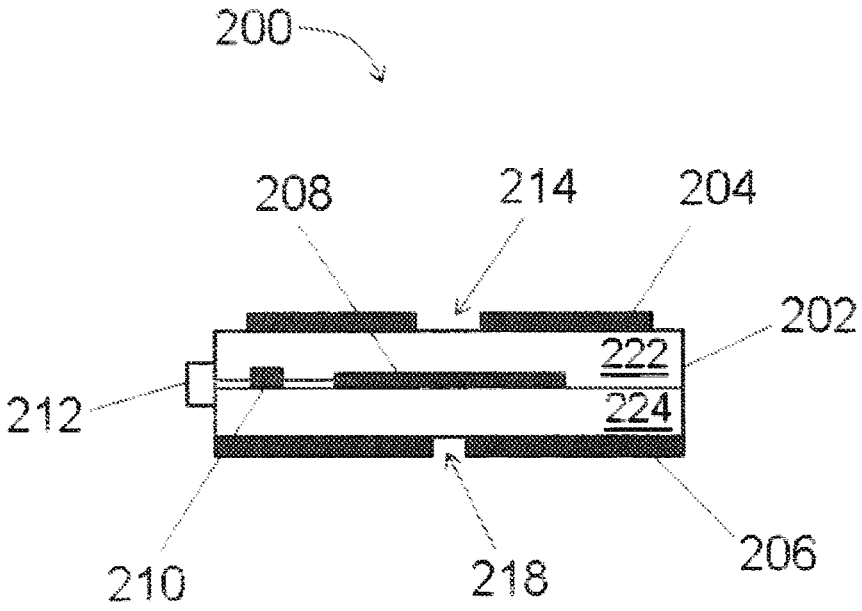
FIG. 2(*a*) illustrates a side view of a multi-beam microstrip antenna, according to an embodiment of the present subject matter.
Figure 2B:
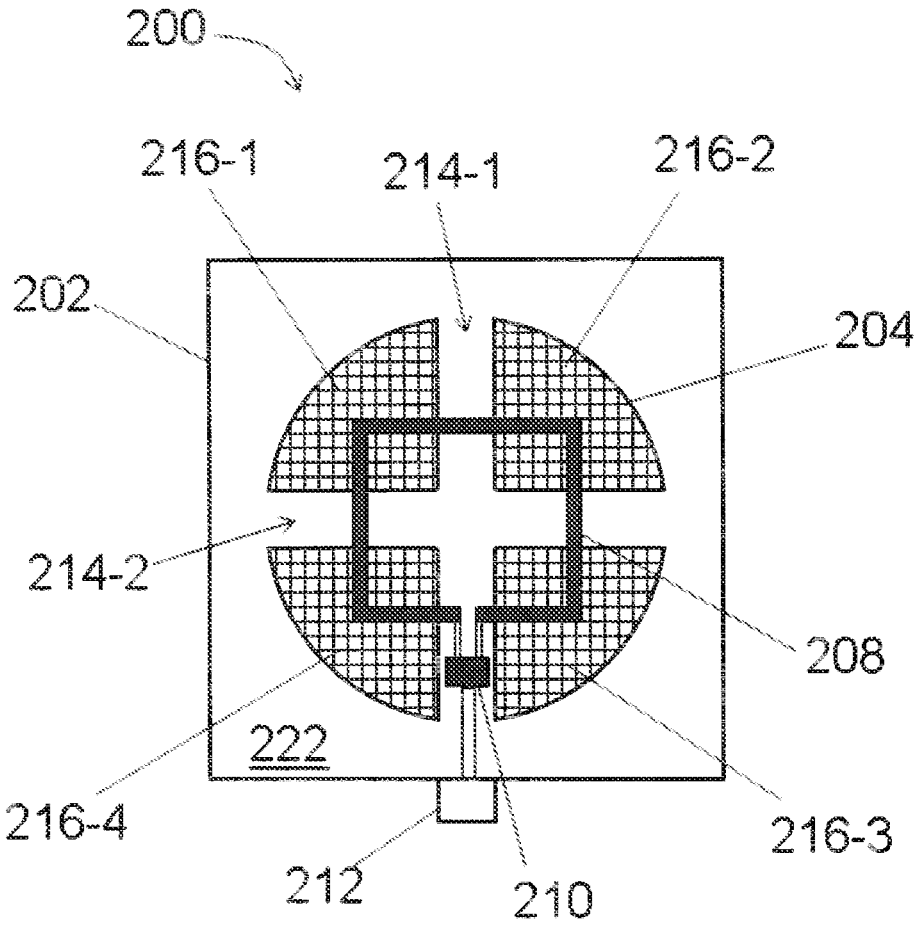
Figure 2C:
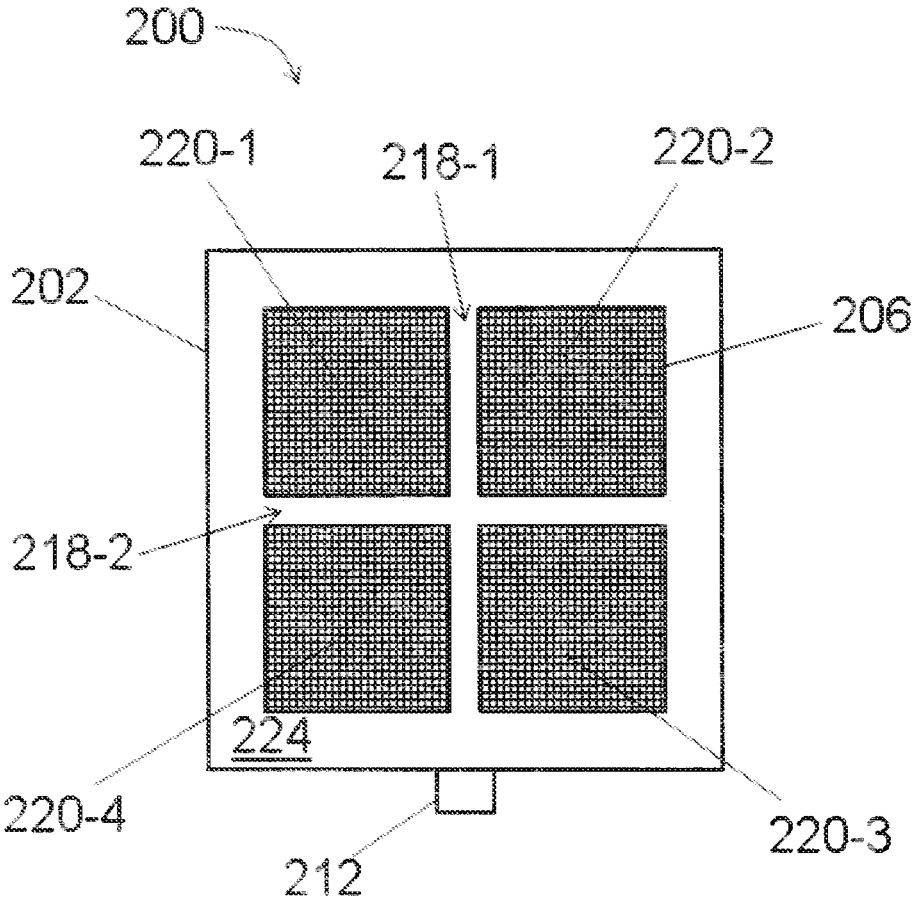

FIGS. 2(*a*), 2(*b*) and 2(*c*) illustrate a multi-beam microstrip antenna 200, according to an embodiment of the present subject matter. FIG. 2(*a*) shows a side view of the microstrip antenna 200. The microstrip antenna 200 includes a dielectric substrate 202 of a predefined height and of a predefined dielectric constant, selected based on antenna characteristics as required for the microstrip antenna 200. The antenna characteristics are described later in the description. The dielectric substrate 202 has, on a first side thereof, a first metallic layer 204 and, on a second side thereof, opposite to the first side, a second metallic layer 206, as shown, As mentioned earlier, the first metallic layer 204 is the top metallic microstrip patch that transmits and receives the EM radiations for wireless communication of data, and the second metallic layer 206 is the metallic ground layer. The first metallic layer 204 and the second metallic layer 206 may be of a predefined thickness, selected based on the antenna characteristics.

Further, as shown in FIG. 2(*a*), the microstrip antenna 200 includes a feed circuit 208 embedded in the dielectric substrate 202. The feed circuit 208 is electromagnetically coupled to the first metallic layer 204 and the second metallic layer 206 through the dielectric substrate 202 for the operation of the microstrip antenna 200, The microstrip antenna 200 also has a balance-unbalance device 210 embedded in the dielectric substrate 202. For the sake of simplicity, the balance-unbalance device 210 hereinafter may be referred to as balun 210. The balun 210 through its balanced port is electrically coupled to the feed circuit 208 for balancing an impedance of the microstrip antenna 200 for the purpose of its operation. Further, the balun 210 through its unbalanced port is electrically coupled to an RF transceiver 212 which, as mentioned earlier, sends and/or receives electrical signals to and/or from the feed circuit 208 for the operation of the microstrip antenna 200.

FIG. 2(*b*) shows the top view of the microstrip antenna 200. In an implementation, as shown, the first metallic layer 204 is of a substantially circular shape and has two end-to-end slots 214-1 and 214-2. The two end-to-end slots 214-1 and 214-2 may be collectively referred to as the end-to-end slots 214 and individually referred to as the end-to-end slot 214. In an implementation, the end-to-end slots 214 may be etched-out on the first metallic layer 204, Further, in an implementation, the end-to-end slots 214 are substantially orthogonal to each other. The two end-to-end slots 214 divide the first metallic layer 204 into four microstrip patches 216-1, 216-2, 216-3 and 216-4, which may be collectively referred to as the microstrip patches 216 and an individually referred to as the microstrip patch 216. With the two end-to-end slots 214, orthogonal to each other, each of the microstrip patches 216 is smaller than a quarter of the first metallic layer 204.

Although, FIG. 2(*b*) shows the first metallic layer 204 of a circular shape with two orthogonal end-to-end slots 214, the first metallic layer 204, in an implementation, may be of any other shape, including a square shape, a rectangular shape, elliptical shape, or any shape as conventionally known. Also, in an implementation, the first metallic layer 204 may have one or more end-to-end slots in any direction along the horizontal plane of the microstrip antenna 200 that divide the first metallic layer 204 into a plurality of microstrip patches. For example, the first metallic layer 204 may be of a square shape with one end-to-end slot that divides the first metallic layer 204 into two rectangular microstrip patches, In another example, the first metallic layer 204 may be of a circular shape with three end-to-end slots that divide the first metallic layer 204 into six microstrip patches. Further, in various implementations, depending on the configuration of the microstrip antenna 200, the microstrip patches 216 formed by the one or more end-to-end slots that divide the first metallic layer 204, may be of identical size or non-identical size.

Further, each of the end-to-end slots 214 in the first metallic layer 204 is of a predefined width and a predefined shape based on the antenna characteristics. In an implementation, the shape of the one or more end-to-end slots 214 in the first metallic layer 204 may be substantially rectangular (as shown in FIG. 2(*b*)), FIG. 2(*c*) shows the bottom view of the microstrip antenna 200. In an implementation, as shown, the second metallic layer 206 is of a substantially square shape with two slots 218-1 and 218-2. The slots 218-1 and 218-2 may be collectively referred to as the slots 218 and individually referred to as the slot 218. In an implementation, the slots 218 may be etched-out slots in the second metallic layer 206. Further, in an implementation, the slots 218 are end-to-end slots and are substantially orthogonal to each other. The two slots 218 divide the second metallic layer 206 into four ground patches 220-1, 220-2, 220-3 and 220-4, which hereinafter may be collectively referred to as the ground patches 220 and an individually referred to as the ground patch 220. With the two slots 218, end-to-end and orthogonal to each other, each of the ground patches 220 is smaller than a quarter of the second metallic layer 206. Similarly to as described for the first metallic layer 204, although, FIG. 2(*c*) shows the second metallic layer 206 of a square shape with two orthogonal end-to-end slots 218, the second metallic layer 206, in an implementation. may be of any other shape, including a rectangular shape, a circular shape, or a shape as conventionally known. Also, in an implementation, the second metallic layer 206 may have no slots, one end-to-centre slot, one end-to-centre and one end-to-end slot, or more similar slots in any direction along the horizontal plane of the microstrip antenna 200. For example, the second metallic layer 206 may be of a circular shape with one end-to-end slot that divides the second metallic layer 206 into two semi-circular ground patches. In an implementation, the slots in the second metallic layer 206 may or may not be substantially aligned with the one or more end-to-end slots in the first metallic layer 204.

Further, each of the slots 218 in the second metallic layer 206 is of a predefined width and a predefined shape based on the antenna characteristics. In an implementation, the width of the slots 218 in the second metallic layer 206 may be less than the width of the end-to-end slots 214 in the first metallic layer 204, and the shape of the slots 218 in the first metallic layer 206 may be substantially rectangular (as shown in FIG. 2(*c*)).

Further, the first metallic layer 204 is of a predefined dimension along the horizontal plane of the microstrip antenna 200 based on the antenna characteristics. The dimension of the first metallic layer may be selected within a range from about ¼ times to about ½ times a free-space wavelength at the operation frequency. For example, for a circular shaped first metallic layer 204 (as shown in FIG. 2(*b*)), the radius of the circular shaped first metallic layer 204 may be within the above mentioned range, and for a square shaped first metallic layer, a side of the square shaped first metallic layer may be within the above mentioned range.

Similarly, the second metallic layer 206 is of a predefined dimension along the horizontal plane of the microstrip antenna 200 based on the antenna characteristics. The dimension of the second metallic layer 206 is such that a coverage area of the second metallic layer 206 is larger than a coverage area of the first metal layer 204.

FIG. 2(*b*) also shows a view of the feed circuit 208, the balun 210 and the electrical couplings thereof, through the first metallic layer 204. It may be understood that the view of the feed circuit 208, the balun 210 and the electrically couplings are shown only for the purpose of depiction. The feed circuit 208 is within the coverage areas of the first metallic layer 204 and the second metallic layer 206, as shown, such that the feed circuit 208 is electromagnetically coupled to the plurality of microstrip patches 216 and the ground patches 220 (or the second metallic layer 206 in case of no slot therein). Further, as shown, the feed circuit 208 is electrically coupled to the balanced port of the balun 210, and the unbalanced port of the balun 210 is electrically coupled to the RF transceiver 212.

In an implementation, the feed circuit 208 may be a loop circuit, which may be understood as a ring-like circuit. The feed circuit 208 may be formed by a continuous metallic strip of a predefined width. The material and the width of the metallic strip may be selected based on the antenna characteristics. The feed circuit 208, as shown, may be a square loop circuit. However, in an implementation, the feed circuit 208 may be a loop circuit of another shape, such as a polygonal loop circuit, a circular loop circuit and an elliptical loop circuit.

As mentioned earlier, the feed circuit 208 is embedded in the dielectric substrate 202. The embedding of the feed circuit 208 in the form of a loop circuit allows the same feed. circuit 208 to electromagnetically couple, simultaneously, with all the plurality of microstrip patches 216 and the ground patches 220 (or the second metallic layer 206). This facilitates in providing a substantially strong mutual coupling amongst the plurality of microstrip patches 216 of the first metallic layer 204, and the coupling of the plurality of microstrip patches 216 with the second metallic layer 206 and the feed circuit 208.

For embedding the feed circuit 208 in the dielectric substrate 202 of the microstrip antenna 200, in an implementation, the dielectric substrate 202 may include two dielectric slabs, namely a first dielectric slab 222 and a second dielectric slab 224, as shown in FIG. 2(*a*). The top side of the second dielectric slab 224 may have the feed circuit 208, the balun 210 electrically coupled to the feed circuit 208 and an electrical connection from the balun 210 for coupling the balun 210 with the RF transceiver 212. The bottom side of the second dielectric slab 224 may have the second metallic layer 206, Further, the top side of the first dielectric slab 222 may have the first metallic layer 204. To form the microstrip antenna 200, the first dielectric slab 222 and second dielectric slab 224 are coupled to each other, such that the first dielectric slab 222 is on top of the second dielectric slab 224 with the first metallic layer 204 on the top, the second metallic layer 206 at the bottom and the feed circuit 208 and the balun 210 in between. Also, the RF transceiver 212 is coupled to the electrical connection coupled from the balun 210, In an implementation, the first dielectric slab 222 and the second dielectric slab 224 are coupled to each other using an adhesive. The adhesive may be of substantially the same dielectric constant as that of the dielectric slabs 222 and 224.

Figure 3A:
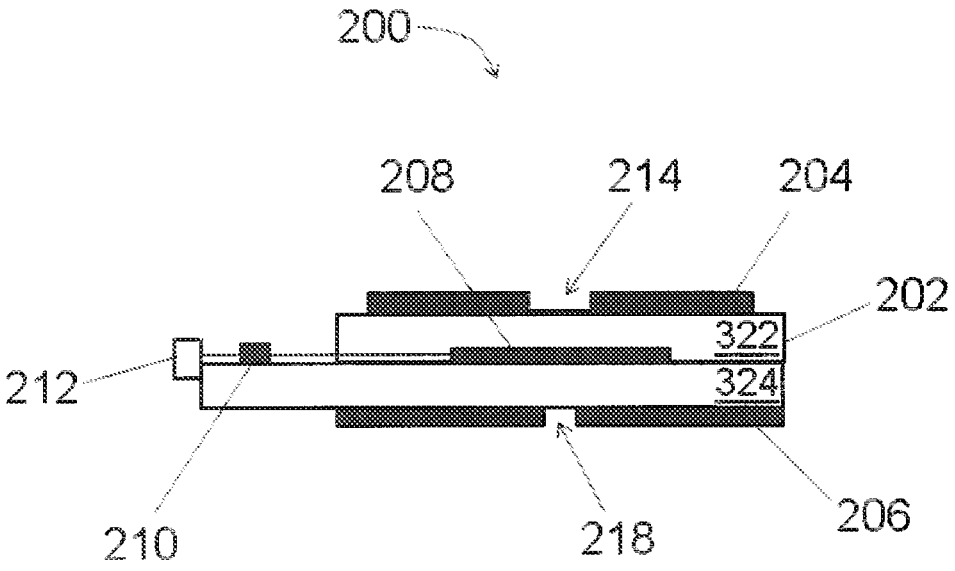
FIG. 3(*a*) illustrates a side view of a multi-beam microstrip antenna, according to an embodiment of the present subject matter.
Figure 3B:
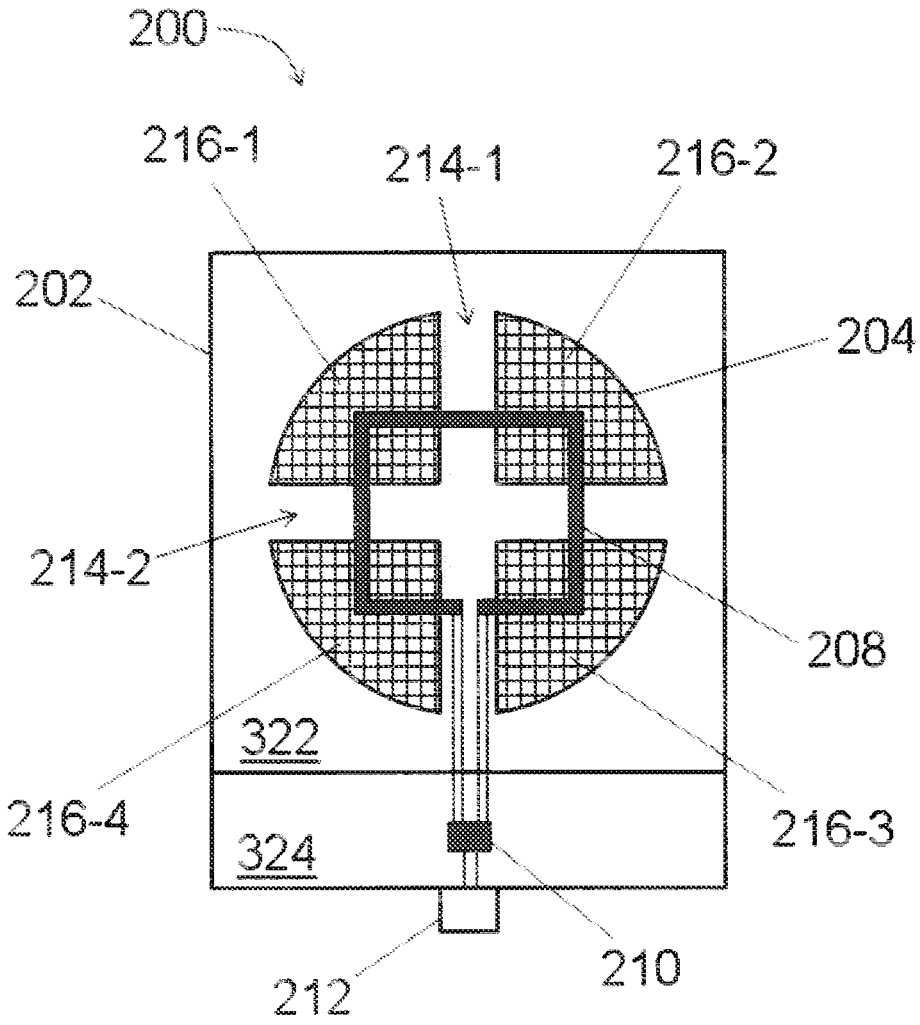
Figure 3C:
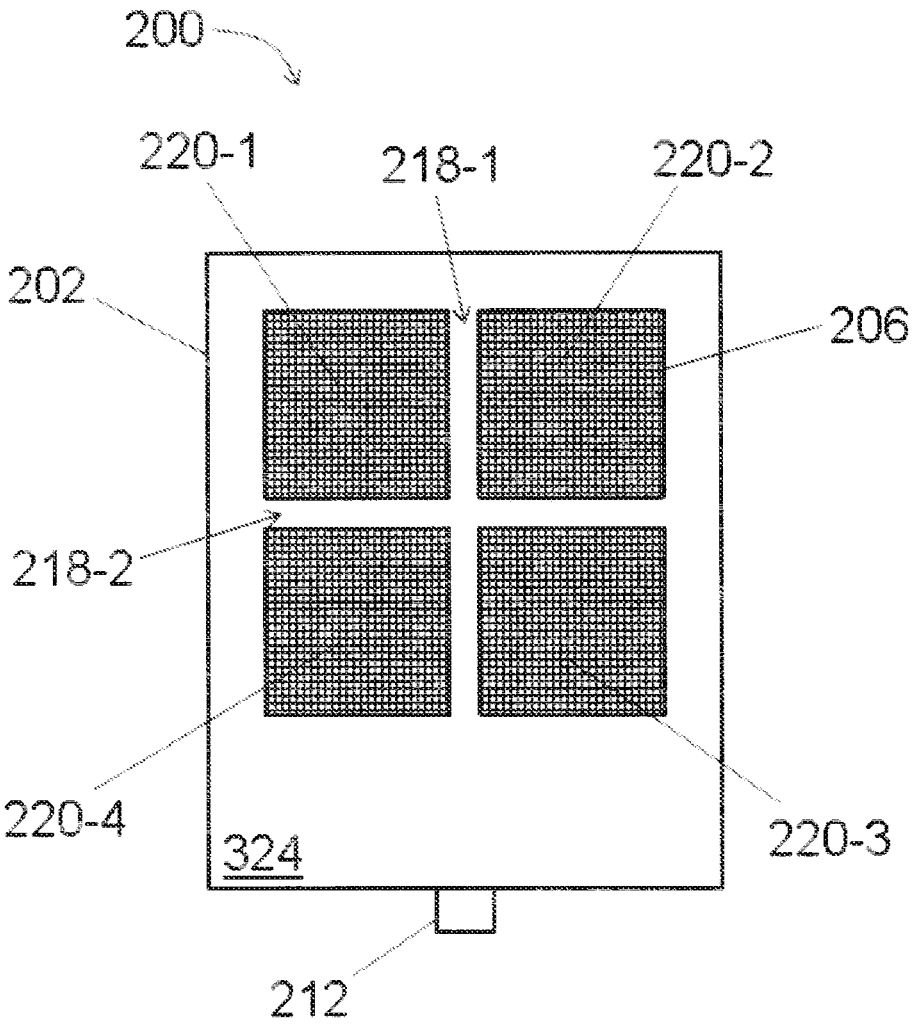
Figure 4A:
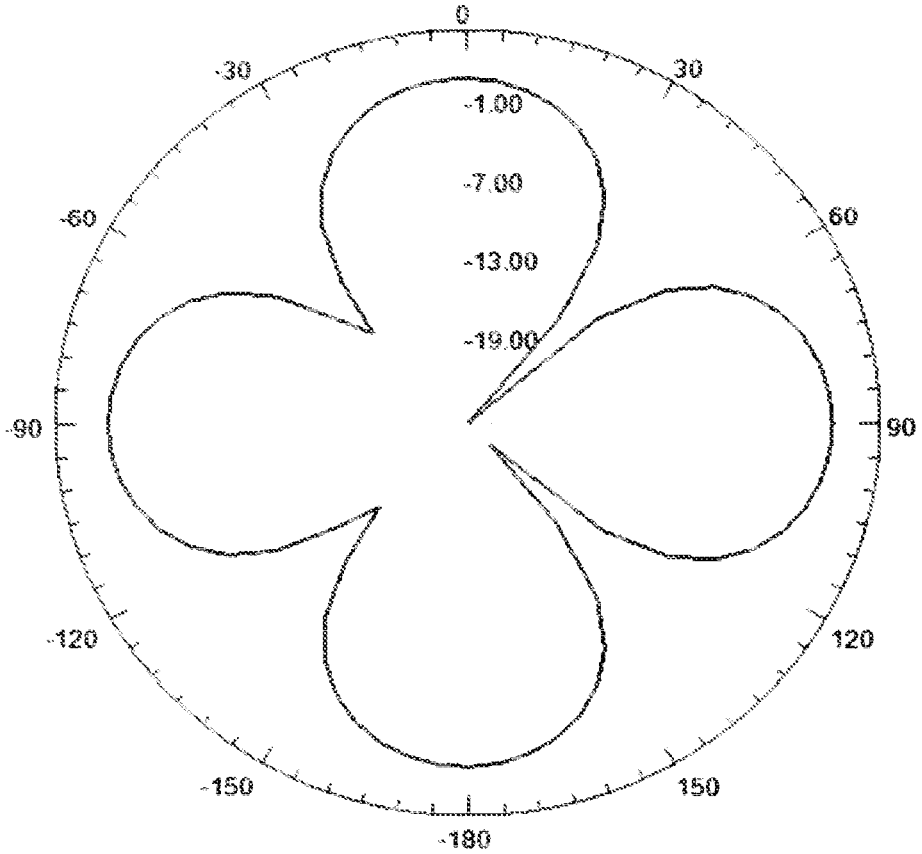
FIG. 4(*a*) shows a simulated radiation pattern for a microstrip antenna, according to an embodiment of the present subject matter.
Figure 4B:
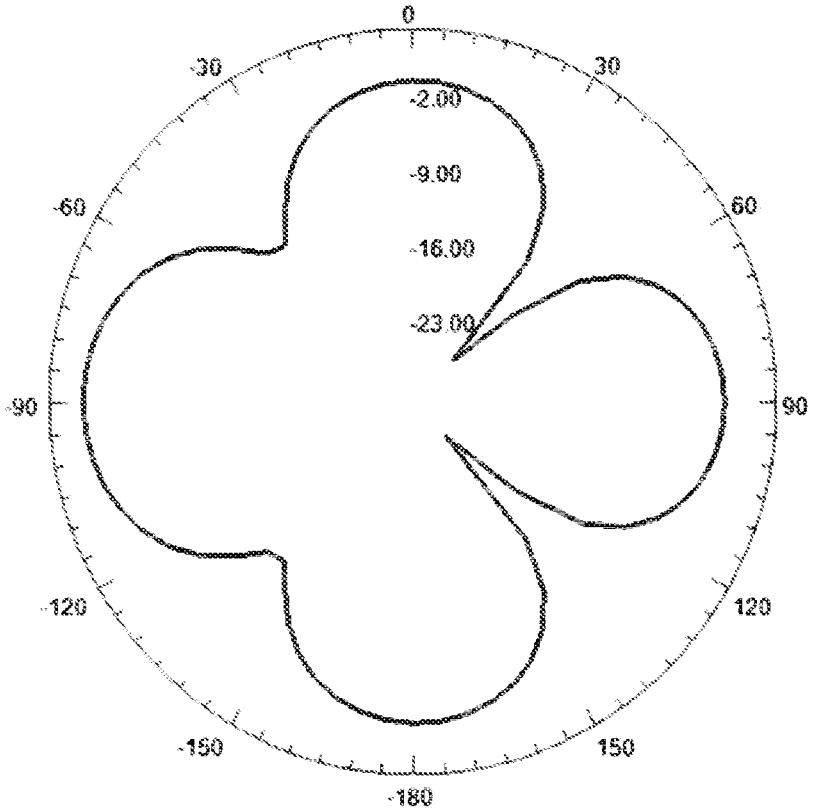
Figure 4C:
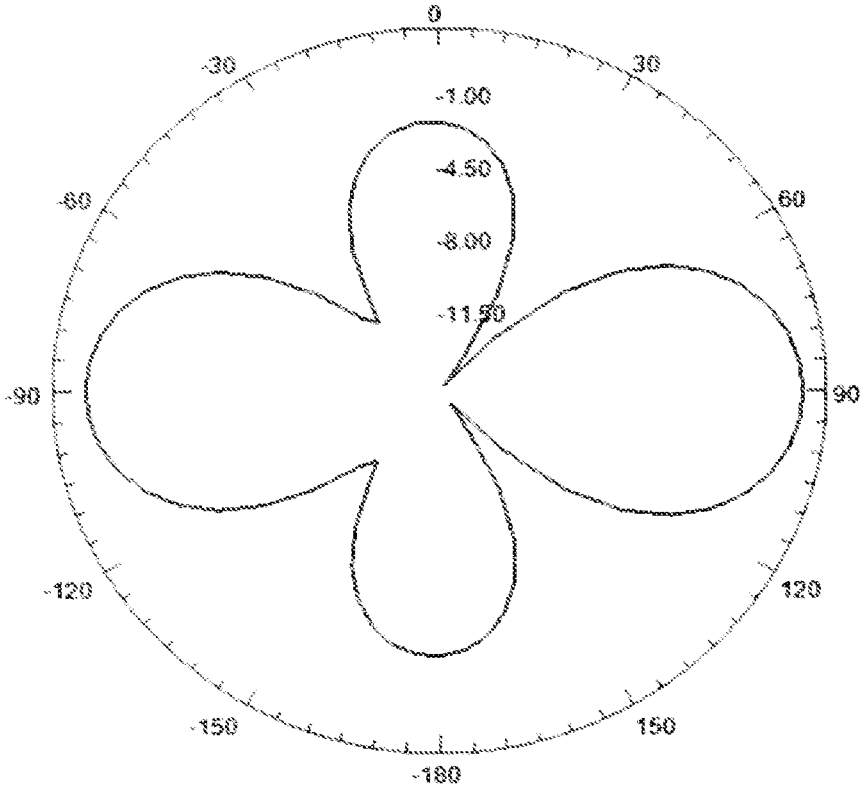
Figure 4D:
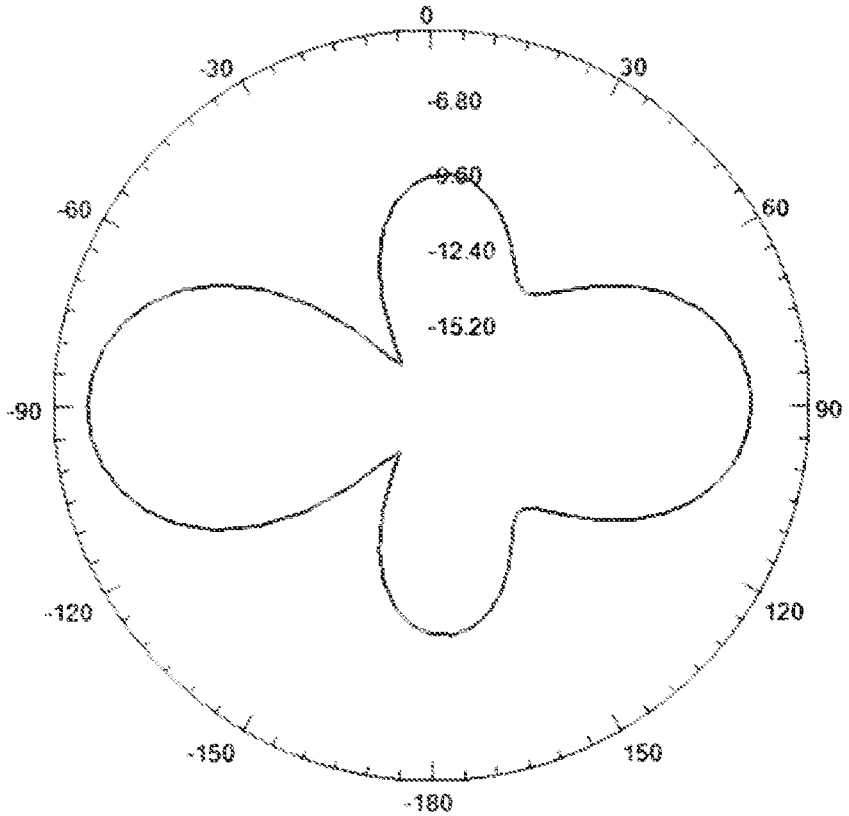

FIGS. 3(*a*), 3(*b*) and 3(*c*) illustrate a multi-beam microstrip antenna 200, according to another embodiment of the present subject matter. FIG. 3(*a*) shows a side view of the microstrip antenna 200, FIG. 3(*b*) shows the top view of the microstrip antenna 200, and FIG. 3(*c*) shows the bottom view of the microstrip antenna 200. Structural elements of the microstrip antenna 200 of FIGS. 3(*a*) to 3(*c*) are similar to those of the microstrip antenna 200 shown in FIGS. 2(*a*) to 2(*c*) with a difference in the respective dielectric substrates 202, The dielectric substrate 202 of the microstrip antenna 200 includes a first dielectric slab 322 and a second dielectric slab 324 of different sizes. As shown, one of the dimensions of the second dielectric slab 324, i.e., the dielectric slab at the bottom, is longer than that of the first dielectric slab 322. In this microstrip antenna 200, the balun 210, the electrical connection between the balun 210 and the RF transceiver 212, and partial the electrical coupling between the balun 210 and the feed circuit 208 are effectively outside the dielectric substrate 202 and not embedded within the dielectric substrate 202. This configuration facilitates in easy fabrication of the microstrip antenna 200.

FIGS. 2(*a*) to 2(*c*) and 3(*a*) to 3(*c*) illustrate the microstrip antenna 200 according to embodiments of the present subject matter. Other configurations of the microstrip antenna 200 are also possible by varying and selecting design parameters of the microstrip antenna 200 to achieve desirable antenna characteristics. The design parameters of the microstrip antenna 200 may include the following:

- materials, dimensions, shapes of first metallic layer 204 and second metallic layer 206;
- number, width and shapes of the end-to-end slots 214 in the first metallic layer 204;
- number, width and shape of slots 218 in the second metallic layer 206; height and dielectric constant of the dielectric substrate 202;
- material, shape, size and width of the metallic strip of the feed circuit 208; and
- impedance and other balancing parameters of the balun 210.

Each combination of such design parameters of the microstrip antenna 200 is selected based on the desirable antenna characteristics, which may include the operating frequency, radiation pattern, power gain and beam width of the microstrip antenna 200. Other antenna characteristics include efficiency and bandwidth of the microstrip antenna 200.

The microstrip antenna 200 may be configured to operate in a transmission mode or a reception mode, or in both. In the transmission mode, the RF transceiver 212 sends RF electrical signals to the feed circuit 208. The electromagnetic coupling of the microstrip patches 216 of first metallic layer 204 and the second metallic layer 206 with the feed circuit 208, allows the microstrip patches 216 to radiate or transmit EM radiations of an RF at which the microstrip antenna 200 operates, based on the electrical signals. In the reception mode, the microstrip patches 216 receive EM radiations of an RF at which the microstrip antenna 200 is operating. The electromagnetic coupling of the microstrip patches 216 of the first metallic layer 204 and the second metallic layer 206 with the feed circuit 208 produces RF electrical signals in the feed circuit 208. The feed circuit 208 sends the RF electrical signals to the RF transceiver 212, may be for further processing. The operation of a microstrip antenna is known to a person skilled in the art and, thus, is not described in detail in the description herein.

As described earlier, the microstrip antenna 200 of the present subject matter can be configured as a single-beam or a multi-beam microstrip antenna 200. The radiation pattern of the microstrip antenna 200 may include one or more main radiation lobes in specific direction with deep nulls around the main radiation lobes, depending on the combination of design parameters, particularly the configuration of slots in the first metallic layer 204 and the second metallic layer 206. The microstrip antenna 200 may be configured for a desirable radiation pattern depending on the application for which the microstrip antenna 200 is used. Some of the applications of the microstrip antenna 200 in reference to the radiation pattern are mentioned later in the description. Further, even though the dimensions of the microstrip antenna 200 are similar to a conventional microstrip antenna 100, the microstrip antenna 200 has substantially higher power gains in specific directions due to the distribution of power gain in accordance with the configuration of slots in the first metallic layer 204 and the second metallic layer 206. In addition, the microstrip antenna 200 has a narrower beam width and a larger bandwidth than those for the conventional microstrip antenna 100. As mentioned earlier, such antenna characteristics of the microstrip antenna 200 are achieved due to the substantially strong mutual coupling amongst the plurality of microstrip patches 216 of the first metallic layer 204, and the coupling of the plurality of microstrip patches 216 with the second metallic layer 206 and the feed circuit 208.

FIGS. 4(*a*), 4(*b*), 4(*c*) and 4(*d*) illustrate radiation patterns of the microstrip antenna 200 designed to operate at the operating frequency of about 3.6 GHz. The radiation patterns in FIGS. 4(*a*) to 4(*d*) are the simulated radiation patterns obtained using Electromagnetic Simulation Software, such as HFSS™. Table 1 lists the various design parameters of the microstrip antenna 200 selected for the purpose of simulation of radiation patterns.

TABLE 1

| Design Parameter | Details |
|---|---|
| Height of dielectric substrate 202 | 1.6 mm |
| Dielectric constant of the dielectric substrate 202 | 4.4 (material is FR-4) |
| Shape of first metallic layer 204 | Circular |
| Radius of first metallic layer 204 | 19 mm |
| Number of end-to-end slots 214 in the first metallic layer 204 | 2 orthogonal slots |
| Shape of end-to-end slots 214 in the first metallic layer 204 | Rectangular |
| Width of end-to-end slots 214 in the first metallic layer 204 | 2 mm |
| Number of slots 218 in the second metallic layer 206 | no slot<br>one end-to-centre slot<br>one end-to-end slot<br>one end-to-centre slot and one end-to-end slot orthogonal to each other<br>two orthogonal end-to-end slots |
| Shape of slots 218 in the second metallic layer 206 | Rectangular |
| Width of slots 218 in the second metallic layer 206 | 0.4 mm |
| Impedance of balun 210 | about 50 ohms to about 70 ohms |
| Material of first metallic layer 204, second metallic layer 206 and feed circuit 208 | Copper |
| Shape of feed circuit 208 | Square |
| Width of metallic strip of feed circuit 208 | 0.46 mm |

As described earlier, the radiation pattern of an antenna is a 3-dimensional plot representing directions in which or from which the antenna transmits or receives the EM radiations and the power gains of the transmitted or received EM radiations, where regions in which the antenna transmits or receives the EM radiations with substantial power gains are represented by main radiation lobes. Antennas typically transmit and received EM radiations above the plane of antenna. The radiation patterns are plots in spherical coordinates (r, ϕ, θ). FIGS. 4(*a*) to 4(*d*) show azimuth radiation patterns for the microstrip antenna 200 with θ=90°, i.e., the radiation pattern at the plane of microstrip antenna.

FIG. 4(*a*) shows a simulated radiation pattern for the microstrip antenna 200 with the design parameters as mentioned in Table 1, where the second metallic layer 206 has two orthogonal end-to-end slots. The radiation pattern herein shows four distinct main radiation lobes in four directions and with peak power gain of about 1.5 dBi, azimuth 3dB beam width of about 23° and bandwidth more than 11%. Also, each of the main radiation lobes has deep nulls around it. The microstrip antenna 200 with such a radiation pattern may be used for application where wireless connectivity requirement is not uniform, i.e., with connectivity in some directions with intermittent regions being not in service. Further, the radiation pattern for the microstrip antenna 200 with two end-to-end slots in the second metallic layer 206 shows a deep null along θ=0° (not shown in FIG. 4(*a*)). Thus, if such a microstrip antenna 200 is implemented horizontally, minimal EM radiations are transmitted towards normal to the antenna, which may be undesirable for the application of the microstrip antenna 200.

FIG. 4(*b*) shows a simulated radiation pattern for the microstrip antenna 200 with the design parameters as mentioned in Table 1, where the second metallic layer 206 has one end-to-centre slot and one end-to-end slot. The radiation pattern herein shows a higher peak power gain and one of the main radiation lobes broader than the other main radiation lobes.

FIG. 4(*c*) shows a simulated radiation pattern for the microstrip antenna 200 with the design parameters as mentioned in Table 1, where the second metallic layer 206 has one end-to-end slot. The radiation pattern herein shows two main radiation lobes, opposite to each other, with higher power gains and two radiation lobes, orthogonal to the previous ones, with lower power gains. The microstrip antenna 200 with such a radiation pattern may be used for applications where wireless connectivity requirement is along a narrow lateral dimension. In an example, such a microstrip antenna 200 may be implemented for wireless communication in long corridors.

FIG. 4(*d*) shows a simulated radiation pattern for the microstrip antenna 200 with the design parameters as mentioned in Table 1, where the second metallic layer 206 has no slot. The radiation pattern herein shows one distinct main radiation lobe.

Although embodiments for the microstrip antenna have been described in language specific to structural features, it is to be understood that the invention is not necessarily limited to the specific features described. Rather, the specific features are disclosed and explained in the context of a few embodiments for the microstrip antenna.

Other advantages of the inventive microstrip antenna will become better understood from the description and claims of an exemplary embodiment of the microstrip antenna. The inventive microstrip antenna of the present subject matter is not restricted to the embodiments that are mentioned above in the description.

Although the subject matter has been described with reference to specific embodiments, this description is not meant to be construed in a limiting sense. Various modifications of the disclosed embodiments, as well as alternate embodiments of the subject matter, will become apparent to persons skilled in the art upon reference to the description of the subject matter. It is therefore contemplated that such modifications can be made without departing from the spirit or scope of the present subject matter as defined.

We claim:

1. A microstrip antenna comprising:

a dielectric substrate;

a first metallic layer on a first side of the dielectric substrate, wherein the first metallic layer comprises one or more end-to-end slots to divide the first metallic layer into a plurality of microstrip patches;

a second metallic layer on a second side, opposite to the first side, of the dielectric substrate, wherein the second metallic layer comprises two end-to-end slots and wherein the two end-to-end slots are of predefined widths based on a radiation pattern; and a feed circuit electromagnetically coupled to the plurality of microstrip patches and the second metallic layer.

2. The microstrip antenna as claimed in claim 1, wherein the first metallic layer is of a predefined first shape based on a radiation pattern, wherein the predefined first shape is one selected from a group consisting of a circular shape, an elliptical shape, a rectangular shape, and a square shape.

3. The microstrip antenna as claimed in claim 1, wherein the first metallic layer is of a predefined dimension along a plane of the dielectric substrate, wherein the predefined dimension is based on an operation frequency and the radiation pattern.

4. The microstrip antenna as claimed in claim 3, wherein the predefined dimension of the first metallic layer is in a range from about ¼ times to about ½ times a free-space wavelength of EM radiations, transmitted and received by the microstrip antenna, at the operation frequency.

5. The microstrip antenna as claimed in claim 1, wherein two end-to-end slots of the one or more end-to-end slots are orthogonal with respect to each other.

6. The microstrip antenna as claimed in claim 1, wherein the one or more end-to-end slots in the first metallic layer is of the predefined width based on a radiation pattern.

7. The microstrip antenna as claimed in claim 1, wherein the second metallic layer is of a predefined second shape based on the radiation pattern, wherein the predefined second shape is one of a rectangular shape and a square shape.

8. The microstrip antenna as claimed in claim 1, wherein the second metallic layer is of a predefined dimension along the plane of the dielectric substrate, wherein, with the predefined dimension, a coverage area of the second metallic layer is larger than a coverage area of the first metal layer.

9. The microstrip antenna as claimed in claim 1, wherein the two end-to-end slots in the second metallic layer are orthogonal with respect to each other.

10. The microstrip antenna as claimed in claim 1, wherein the feed circuit is a loop circuit embedded in the dielectric substrate, and is configured between the first metallic layer and the second metallic layer.

11. The microstrip antenna as claimed in claim 10, wherein the loop circuit is one selected from a group consisting of a circular loop circuit, elliptical loop circuit, and a polygonal loop circuit.

12. The microstrip antenna as claimed in claim 1, further comprising a balun, wherein the feed circuit is coupled to balanced ports of the balun.

13. The microstrip antenna as claimed in claim 12, wherein the balun is coupled to a radio-frequency transceiver through an unbalanced port of the balun.

14. The microstrip antenna as claimed in claim 1, wherein the dielectric substrate comprises a first dielectric slab and a second dielectric slab coupled to the first dielectric slab, wherein:

the first metallic layer is on a top side of the first dielectric slab; and the second metallic layer is on a bottom side of the second dielectric slab, and the feed circuit is on a top side of the second dielectric slab.

15. A microstrip antenna comprising:

a dielectric substrate;

a first metallic layer on a first side of the dielectric substrate, wherein the first metallic layer comprises one or more end-to-end slots to divide the first metallic layer into a plurality of mictostrip patches;

a second metallic layer on a second side, opposite to the first side, of the dielectric substrate, wherein the second metallic layer has one end-to-centre slot and wherein the end-to-centre slot is of a predefined width based on a radiation pattern; and a feed circuit electromagnetically coupled to the plurality of microstrip patches and the second metallic layer.

16. A microstrip antenna comprising:

a dielectric substrate;

a first metallic layer on a first side of the dielectric substrate, wherein the first metallic layer comprises one or more end-to-end slots to divide the first metallic layer into a plurality of microstrip patches;

a second metallic layer on a second side, opposite to the first side, of the dielectric substrate, wherein the second metallic layer has one end-to-end slot and wherein the end-to-end slot is of a predefined width based on a radiation pattern; and a feed circuit electromagnetically coupled to the plurality of microstrip patches and the second metallic layer.

17. The microstrip antenna as claimed in claim 16, wherein the second metallica layer comprises one end-to-end slot and one end-to-centre slot, wherein the end-to-centre slot and the end-to-end slot are of predefined widths based on the radiation pattern.

* * * * *